US007075496B2

(12) United States Patent
Hidai et al.

(10) Patent No.: US 7,075,496 B2
(45) Date of Patent: Jul. 11, 2006

(54) FAN-BEAM ANTENNA

(75) Inventors: Takashi Hidai, Tokyo (JP); Kazuyoshi Ono, Tokyo (JP)

(73) Assignee: Taiyo Musen, Co., Ltd., Tokyo (JP)

( * ) Notice: Subject to any disclaimer, the term of this patent is extended or adjusted under 35 U.S.C. 154(b) by 15 days.

(21) Appl. No.: 10/939,341

(22) Filed: Sep. 14, 2004

(65) Prior Publication Data

US 2005/0062664 A1 Mar. 24, 2005

(30) Foreign Application Priority Data

Sep. 22, 2003 (JP) ..... 2003-366637

(51) Int. Cl.
*H01Q 19/06* (2006.01)
*H01Q 13/00* (2006.01)

(52) U.S. Cl. ..... 343/786; 343/911 R; 343/753

(58) Field of Classification Search ..... 343/771, 343/770, 772, 786, 911 R, 753, 781 R
See application file for complete search history.

(56) References Cited

U.S. PATENT DOCUMENTS

| | | | | |
|---|---|---|---|---|
| 3,935,577 | A * | 1/1976 | Hansen | 343/781 R |
| 5,117,240 | A * | 5/1992 | Anderson et al. | 343/786 |
| 5,935,190 | A * | 8/1999 | Davis et al. | 701/119 |
| 6,281,853 | B1 * | 8/2001 | Caille et al. | 343/754 |
| 6,891,513 | B1 * | 5/2005 | Kienzle et al. | 343/786 |
| 6,950,073 | B1 * | 9/2005 | Clymer et al. | 343/713 |

* cited by examiner

*Primary Examiner*—Don Wong
*Assistant Examiner*—Hung Tran Vy
(74) *Attorney, Agent, or Firm*—Wenderoth, Lind & Ponack, L.L.P.

(57) ABSTRACT

An object of the invention is to provide a fan-beam antenna which comprises a flare which is long in a horizontal direction thereof and whose cross section is horn-shaped, and a water-proof box housing components of said antenna, in which a vertical beam width is made narrow without spreading a vertical size to increase gain. Accordingly, this invention is characterized in that a radome radiation surface is constituted of a plurality of dielectric plates equivalently, and at least one of the dielectric plates is made a dielectric lens having a characteristic similar to a convex lens.

3 Claims, 4 Drawing Sheets

FAN-BEAM ANTENNA

BACKGROUND OF THE INVENTION

The present invention relates to a fan-beam antenna which is used in a radar system etc. and in which a level surface beam width is made narrow and a vertical surface beam width is made wide, and further in which dielectric lenses are used together for an antenna in which a vertical surface directivity is restricted by a horn-shaped flare.

In a radar system detecting a target by scanning a directivity antenna over a whole circumference or in a specific sector, an array antenna is provided with a flare such as a slot array antenna in which radiation elements are arranged in a horizontal direction to reduce the horizontal surface beam width and to restrict a vertical surface beam width easily by the horn-shaped flare in a vertical direction.

Proposals such that a gain is secured while restraining an opening of the flare to a practical size by such array antenna with a flare, for instance an S-band radar for shipping, namely such that a vertical surface beam width is made narrow, are shown in JP 60-261204 A and JP 62-171301. It can be considered that these antennas are constituted by projecting several thin dielectric plates in two or three wavelengths to a radiation direction, so that these dielectric plates serve as a waveguide such as a dielectric rod antenna, or it is a dielectric antenna with a small dielectric constant in case of considering an average dielectric constant to a space around the dielectric plate.

On the other hand, it is considered that using a dielectric lens (6) which consists of a single material and is constituted in a convex lens shape as shown in FIG. 6 illustrating an embodiment which is made practicable in a pencil beam antenna, a method for restraining reflection by setting a dielectric lens (7) so as to decrease a dielectric constant in a border surface to a space and to increase the dielectric constant to a center portion of the lens gradually as shown in FIG. 7, or a method for restraining reflection by forming adjustment layers in a dielectric lens (8) by covering a dielectric lens (8*a*) having a large dielectric constant with a dielectric (8*b*) having a relatively small dielectric constant (1/the square root) at a thickness that an electric length becomes a quarter wavelength is applied to a fan beam antenna.

In an example disclosed in JP 60-261204 A or JP 62-171301 A, there is a disadvantage such that a size in a propagation direction becomes larger though a vertical size can be restrained in a method for projecting the above mentioned dielectric plate with a few wavelengths. Besides, in the case of using a single material dielectric lens as shown in FIG. 6, it is necessary to consider the reflection due to the dielectric.

It is generally known that a wave impedance z1 in a medium with a relative permeability 1 and a relative dielectric constant $\epsilon r1$ is in the following relationship if a wave impedance in a space with $\epsilon r0=1$ is z0.

$$z1=z0\cdot\sqrt{\epsilon s1} \quad ①$$

A coefficient of reflection Γ in a border surface between the medium and the space is shown in the following expression ②.

$$\Gamma=\frac{z1-z0}{z1+z0}=\frac{\varepsilon s1-1}{\varepsilon s1+1} \quad ②$$

Furthermore, a voltage standing wave ratio (VSWR) in a border surface between the medium and the space can be shown in the following expression ③.

$$VSWR=\frac{1+\Gamma}{1-\Gamma}=\varepsilon s1 \quad ③$$

According to the expression ③, for instance, if it is desired that VSWR in a border surface between a dielectric and a space is restrained to 1.2, the relative dielectric constant is 1.2. Besides, in the case that border surfaces are two as shown in FIG. 6, two reflection are composed. When considering the worst value, it is necessary to halve each coefficient of reflection Γ, so that the relative dielectric constant is approximately 1.1 when it is looked for by using the expression ②. As a result, it is found that it is necessary to use a material with a much lower dielectric constant. Thus, it can be supposed easily that a thickness of the lens becomes larger, and further problems arise in a forming or a means for securing.

Moreover, as shown in FIGS. 7 and 8, if a dielectric constant in a center portion can be larger, a thickness of the lens can be thinner, but a method for manufacturing compound materials is difficult, so that these methods are rarely used in a fan-beam antenna.

SUMMARY OF THE INVENTION

An object of the present invention is to provide a high-gain fan-beam antenna whose cross-sectional shape is thin by easily constituting a dielectric lens with little reflection in order to resolve the above mentioned problems.

Accordingly, a fan-beam antenna according to the present invention is characterized in that a radiation surface of a radome radiation surface in a water-proof box is constituted of a plurality of dielectric plates equivalently, and one of the dielectric plates is a dielectric lens with a characteristic the same as a convex lens.

Furthermore, a fan-beam antenna according to the present invention is characterized in that a radome radiation surface constituting a part of the water-proof box is constituted of two dielectric plates equivalently, the two dielectric plates are formed in approximately same convex lens shapes, a maximum value of a maximum electric length in a permeation direction of a convex portion of each dielectric plate is a quarter wavelength of a using frequency, and a pitch between the two lenses is an electric length with a quarter wavelength.

Besides, it is characterized in that the radome radiation surface is constituted of three dielectric plates, the dielectric plate located in an outer side is a radome with an approximately even thickness, and two dielectric plates located inside are in a convex lens shape.

Furthermore, it is characterized in that a convex lens shape is not only a simple lens shape, but also a dielectric lens whose cross sectional shape is comb-shaped, and a dielectric lens so that tooth portions of the comb shape are longer in a center of a vertical surface thereof and are shorter in both end sides thereof is used.

Due to this arrangement, a fan-beam antenna according to the present invention can resolve the above mentioned problems.

Therefore, according to the present invention, even if a convenience of a simple extrusion molding or an injection molding is considered, bad reflection can be restrained and a necessary lens effect is gained easily, so that a compact and high-gain fan-beam antenna can be easily obtained.

DETAILED DESCRIPTION OF THE INVENTION

Figure 1:
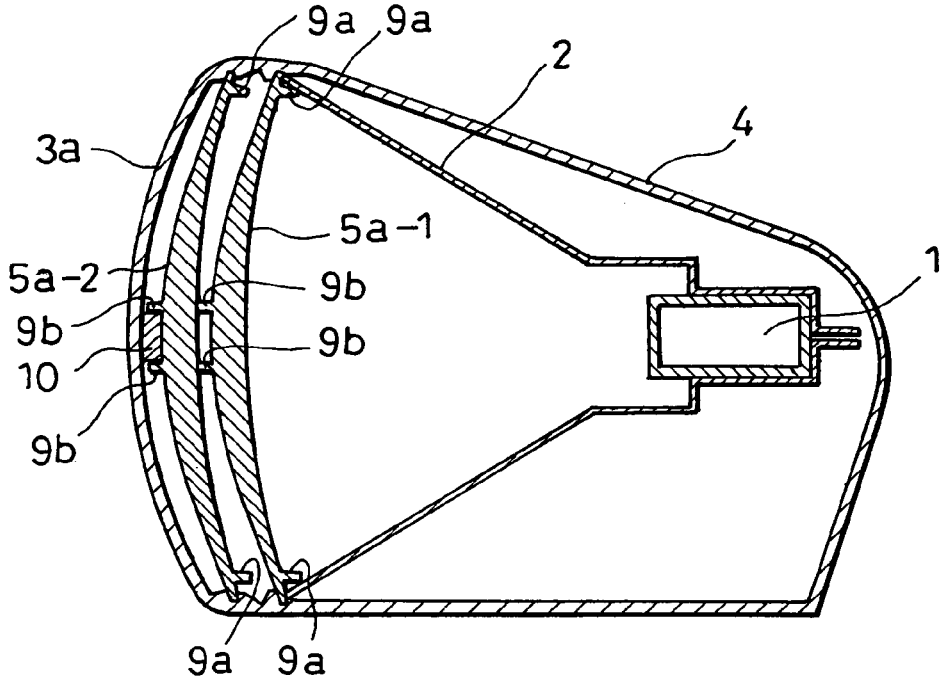
FIG. 1 is a cross section view illustrating a first embodiment of a dielectric lens according to the present invention.

Hereinafter, the best mode for working the invention is explained by referring to the drawings.

A cross section view illustrating a first embodiment of a fan-beam antenna according to the present invention is shown in FIG. 1.

A fan beam antenna shown in FIG. 1 is an example in which a slot waveguide (1) is employed as an array element, wherein two convex-lens-shaped dielectric lenses (5*a*-1, 5*a*-2) and radiation surface radome (3*a*) formed by a dielectric with an even thickness are arranged in an opening portion of a flare (2) and the other portions are covered with a water-proof box (4). Note that mechanical support means for the slot waveguide and the flare, and a feeder system etc. are omitted in the drawing.

Besides, in this embodiment, the radiation surface radome (3*a*) and the water-proof box (4) are united and formed by a cylindrical extrusion molding. Furthermore, the dielectric lenses (5*a*-1, 5*a*-2) are approximately the same shape and formed by an extrusion molding or an injection molding, having a structure to be fit into the water-proof box (4).

Moreover, in this embodiment, the dielectric lenses are provided with supporting projections (9*a*) for supporting the flare (2) in both ends thereof and spacer projections (9*b*) for maintaining a space between the two dielectric lenses at a center portion thereof. A foaming agent (10) with a low dielectric constant as a spacer is arranged between the spacer projections (9*b*) at the center portion of the dielectric lens (5*a*-2) opposite to the radiation surface radome (3*a*) in order to maintain a space between the radiation surface radome (3*a*) and the dielectric lens (5*a*-2).

A thickness of the two dielectric lenses (5*a*-1, 5*a*-2) and a space between the two dielectric lenses (5*a*-1, 5*a*-2) at a center portion in a vertical surface, and a thickness of the radiation surface radome (3*a*) and a space between the radiation surface radome (3*a*) and the dielectric lens (5*a*-2) can be set by considering that transmission lines each of which has wave impedance are connected in series because electromagnetic waves pass through each material in sequence.

Figure 10:
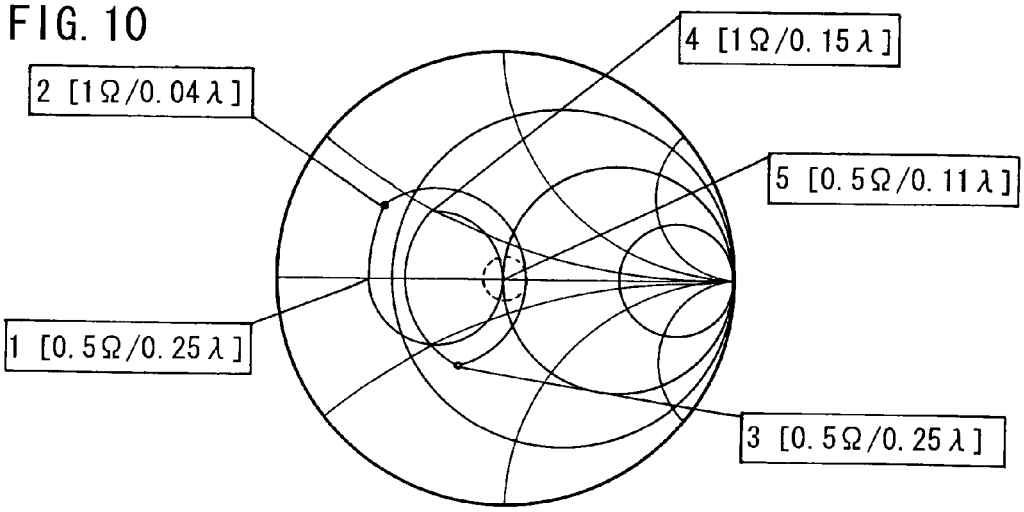
FIG. 10 is a vertical directivity characteristic diagram.

For instance, it is an impedance locus as shown in a Smith chart of FIG. 10, and a final position goes within an adjustment extent of VSWR=1.2 as shown by a dotted line circle in FIG. 10.

In the embodiment in FIG. 10, wave impedance is standardized to 1 when the relative dielectric constant in spaces such as each interval is 1, setting each relative dielectric constant to 4, thus setting wave impedance of each dielectric to ½ which is 1/square root of the relative dielectric constant, so that the thickness of each dielectric in the center of the vertical surface and spaces are set in real measurement in an electrical length (wavelength λ) and 9.4 GHz, as follows:

Thickness of the dielectric lens (5*a*-1): 0.25λ, 4.0 mm

Space between the dielectric lenses (5*a*-1, 5*a*-2): 0.04λ, 1.3 mm Thickness of the dielectric lens (5*a*-2): 0.25λ, 4.0 mm Space between the dielectric lens (5*a*-2) and the radiation surface radome (3*a*): 0.15λ, 4.8 mm Thickness of the radiation surface radome (3*a*): 0.11λ, 1.8 mm Total maximum dielectric thickness of the dielectric lenses is 8 mm, but effective thickness is 6 mm taking into account that the minimum thickness in each end of each lens is 1 mm.

Figure 6:
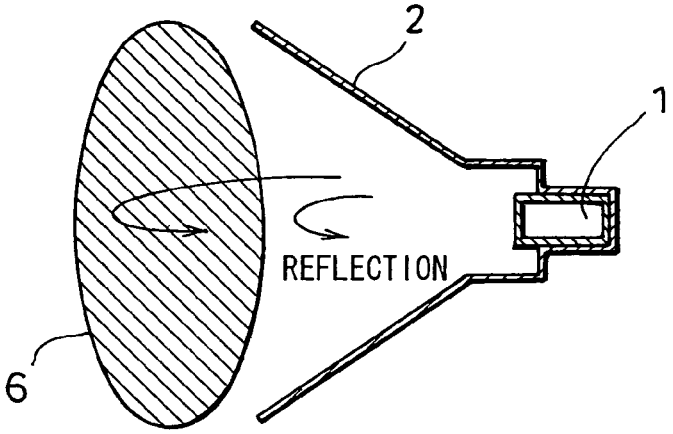
FIG. 6 PRIOR ART
FIG. 6 is a cross section view of a prior dielectric lens with a single material.
Figure 7:
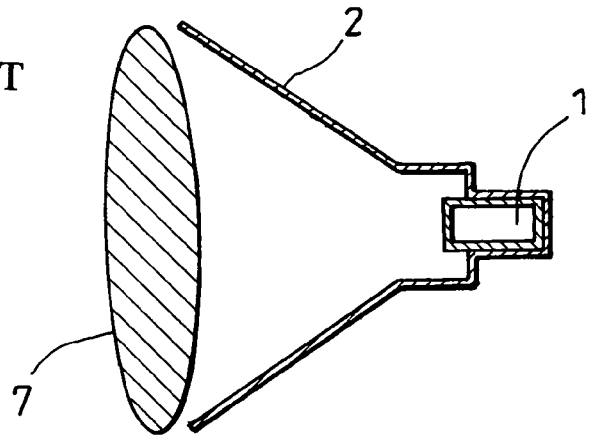
FIG. 7 PRIOR ART
FIG. 7 is a cross section view of a prior dielectric lens with a continuously compound material.
Figure 8:
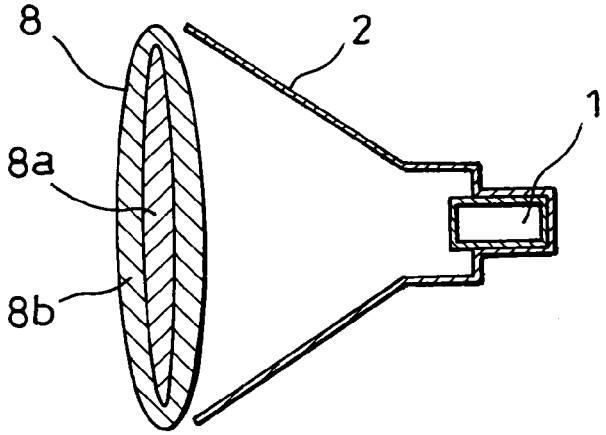
FIG. 8 PRIOR ART
FIG. 8 is a cross section view of a prior compound dielectric lens.
Figure 9:
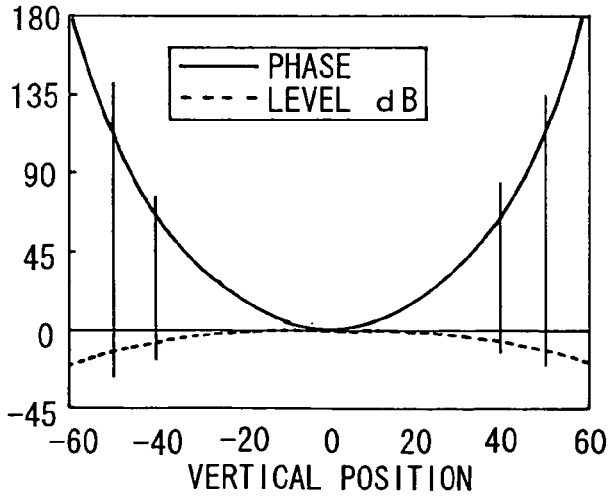
FIG. 9 is a phase distribution diagram in a vertical surface around an opening of a flare.

As one embodiment, a vertical surface phase distribution is illustrated in FIG. 9 for a case when an opening angle of the flare (2) as shown in FIG. 6 is 45°, an opening size is 100 mm and the frequency is 9.4 GHz.

In the embodiment in FIG. 9, the phase is delayed at approximately 110° in positions which are ±50 mm distant from the center portion, so that it is understood that it is better for a lens to be such that the phase in the center portion delays 110° to the end portions.

Here, with the relative dielectric constant of the dielectric lens set to εr, the thickness of it set to d, a free space phase delay ϕ0, a phase delay ϕdi and a difference ϕ between them:

$$\varphi 0 = 2\pi d \frac{1}{\lambda 0} \qquad ④$$

$$\varphi di = 2\pi d \frac{\sqrt{\varepsilon r}}{\lambda 0}$$

$$\varphi = \varphi di - \varphi 0 = 2\pi d \frac{\sqrt{\varepsilon r} - 1}{\lambda 0}$$

Furthermore, in the case of substituting 6 mm as the effective thickness of the center portion for d in the expression ④, approximately 68° can be gained as the phase delay ϕ, that is to say a maximum phase adjustment quantity. This value is smaller than the above-mentioned ideal value, but it is similar to phase delays in positions which are ±40 mm distant from the center as shown in FIG. 9, so that 80% in the openings can be amended, and as a result, sufficient effects as a lens can be expected.

Besides, the thickness of every part in the lens's vertical surface can be found by transforming the expression ④ about d. Furthermore, each of the spaces has only to set up the dimension which can make VSWR low enough in each of the thicknesses.

Figure 11:
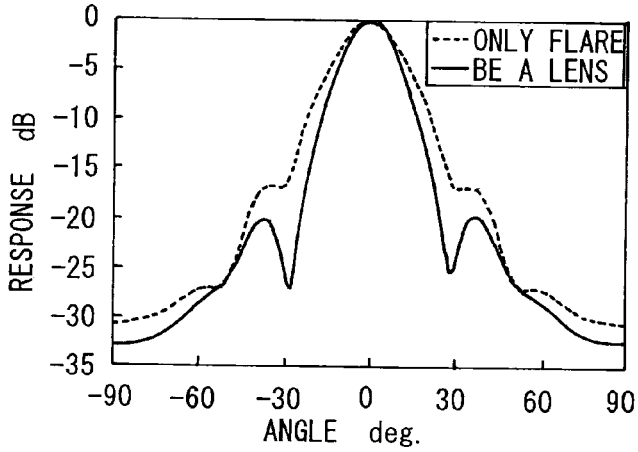
FIG. 11 is a VSWR characteristic diagram.

FIG. 11 illustrates vertical surface directivity characteristics in a case of using only flare and no lens and in case of amending 80% of the opening in the present embodiment.

In FIG. 11, in using the lens, it is shown not only that a beam width of it can be reduced from 21° to 18° but also that a base line of the characteristic becomes sharp, so that gain of it increases approximately 1 dB.

Figure 12:
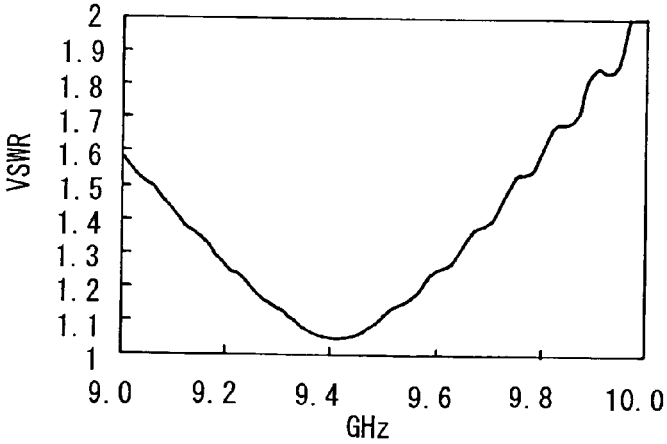
FIG. 12 is a diagram showing VSWR.

FIG. 12 illustrates VSWR by the lens and the radome of this embodiment. It is understood in this figure that reflection is sufficiently restrained around 9.4 GHz as a design frequency.

This embodiment is a best mode in being convenient to form in that it is easier to mold when the thickness is made uniform, for instance, in the case that the radome (3*a*) and the water-proof box (4) are formed unitedly by a cylindrical extrusion molding.

Besides, though the lenses are formed by the extrusion molding or the injection molding, in the case of injection molding, if parts of the lens are partitioned in a horizontal direction thereof and the parts are engaged to the water-proof box (4), molds for the injection molding can be made smaller.

Furthermore, the projection (9*b*) and the spacer (10) are provided only when maintenance of the space between the lens and the radome is difficult, and further, mechanical strength can be increased if the above mentioned engaged portions are glued by a bonding means such as a melt adhesive as the occasion demands.

Figure 2:
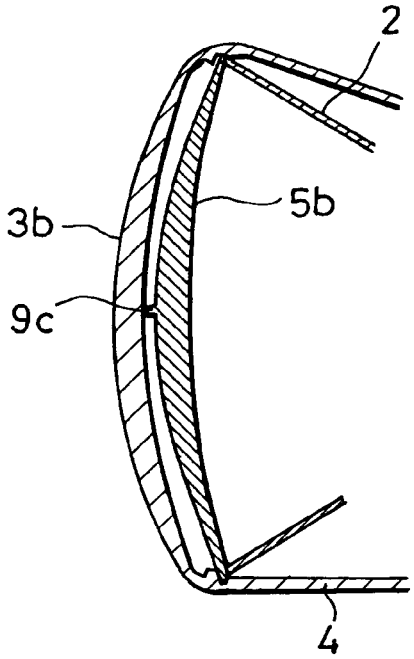
FIGS. 2, 3 and 4 are cross sectional views illustrating a second embodiment of a dielectric lens according to the present invention.
Figure 3:
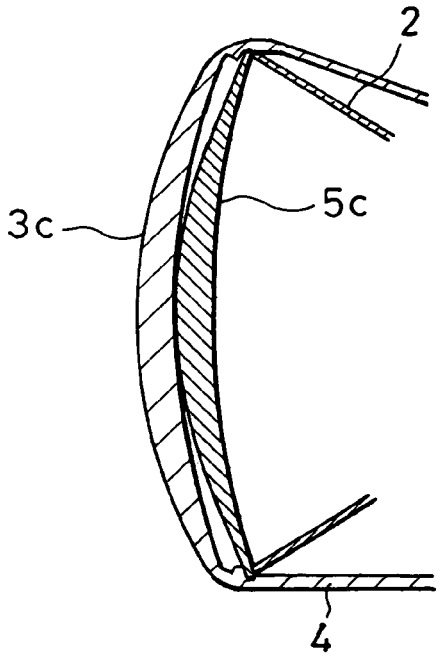
Figure 4:
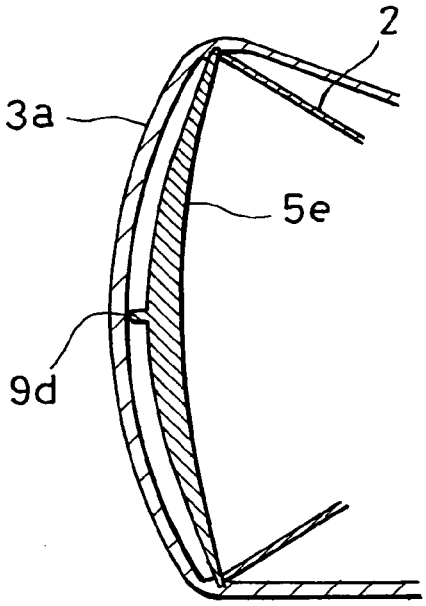

FIGS. 2, 3 and 4 illustrate cross sectional views of a second embodiment of a fan-beam antenna according to the present invention.

FIG. 2 shows an example in which a radome itself is a convex-shaped dielectric lens (3*b*) and a dielectric lens (5*b*) which is similar to the dielectric lens (3*b*) is located inside thereof, a thickness of a center of each lens is set to an electric length equal to or less than a quarter wavelength of a used frequency, and pitch between two lenses over a whole of the vertical surface is set to a quarter wavelength of the electric length.

With this arrangement, an excellent effect for restraining reflection can be gained in a principle such that two same waves which are separated at intervals of a quarter wave length in an advanced direction thereof are negated. Note that the dielectric lens (5*b*) in FIG. 2 is provided with a spacer projection (9*c*) at a center thereof.

FIG. 3 shows an example in which a radome itself is a convex-shaped dielectric lens (3*c*) and a dielectric lens (5*c*) which is similar to the dielectric lens (3*b*) is located inside thereof, a thickness of a center of each lens is set to an electric length equal to a less than a quarter wavelength of a used frequency, and a center portion of the dielectric lens (5*c*) is in contact with the dielectric lens (3*c*).

The examples in FIGS. 2 and 3 are available when the radome (3*b* or 3*c*) is formed separately from the water-proof box (4) or when the thickness can be changed even if it is cylindrical by progress of a forming art. Especially, in the example in FIG. 3, a maximum lens effect as two lenses (3*c*, 5*c*) can be shown by applying when restriction of thickness in forming is eased.

FIG. 4 illustrates an example in which a radome (3*a*) with an approximately uniform thickness and a convex-shaped dielectric lens (5*e*) are arranged. In this case, adjustment for restraining reflection over a whole of the vertical surface as in the first embodiment is impossible, but adjustment can be made only in the center portion mainly, so that an effect of the lens can be gained simply though the restraining of the reflection is insufficient.

FIG. 4 illustrates the example such that thickness at the center of each lens is set to a quarter wave length by promoting the above-mentioned principle further. In this case, a maximum lens effect and an excellent effect for restraining reflection can be gained.

Note that the dielectric lens (5*e*) in FIG. 4 is provided with a spacer projection (9*d*) at a center thereof.

Figure 5:
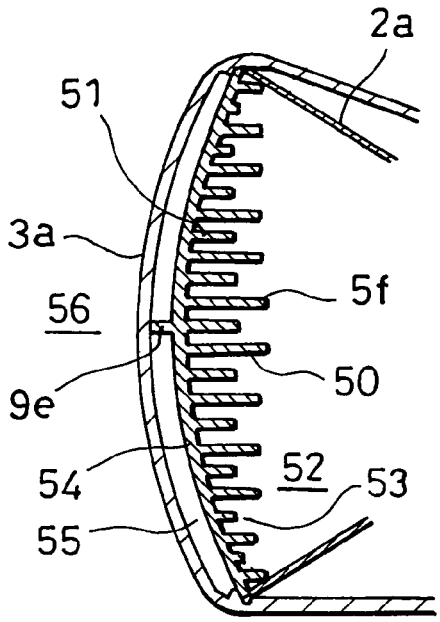
FIG. 5 is a cross section view illustrating a third embodiment of a dielectric lens according to the present invention.

FIG. 5 illustrates a cross sectional view of a third embodiment of a fan-beam antenna according to the present invention. In the embodiment in FIG. 5, a point such that a dielectric lens (5*f*) is formed so as to have a comb-shaped cross section is different from the above embodiments. In this case, this embodiment is such that reflection is restrained by a structure as follows such as to apply an average dielectric constant by gaps (53) between comb tooth portions (50, 51) and a space (52) to gain a desired lens effect.

Note that the dielectric lens (5*f*) in FIG. 5 is provided with a spacer projection (9*e*) at a center thereof.

A portion where density of teeth (50, 51) is the highest: it is a portion which is a dielectric lens (5*f*) and a maximum thickness (length of comb tooth (50)) is set voluntarily by a necessary lens effect.

A portion where density of inside teeth (51) is lower: where an average relative dielectric constant is set so as to be a square root of the relative dielectric constant of the above lens portion, the thickness of it is set as an electric length of a quarter wave length to restrain an inside reflection. A handle portion (54) of the comb: it is necessary in order to hold the teeth (50, 51) and its width is constant as a whole.

A radome (3*a*): its width is constant as a whole and it is water-proof.

A space (55) between the radome (3*a*) and the handle portion (54): it is a necessary space in order to adjust a wave impedance of the lens portion and a wave impedance of the handle portion (54), and a wave impedance of the radome (3*a*) and a wave impedance of a space (56) outside the radome.

This embodiment is the most available when there is a convenience of forming such that it is desired to hold a forming thickness approximately constant in the case that the dielectric lens is formed by injection molding especially. Besides, in this case, a simple convex-shaped comb shape can be employed as dielectric lenses in the above-mentioned first and second embodiments.

What is claimed is:

1. A fan-beam antenna comprising at least:

a flare which is long in a horizontal direction thereof and whose cross section is horn-shaped;

a water-proof box housing components of said antenna; and a radome radiation surface which is located in front of said flare and constituted of a part of said water-proof box;

wherein said radome radiation surface is constituted of a plurality of dielectric plates equivalently;

wherein at least one of said dielectric plates is a dielectric lens having a characteristic similar to a convex lens;

wherein said radome radiation surface is constituted of three dielectric plates;

wherein one of said dielectric plates which is located most outside thereof is a radome whose thickness is approximately uniform; and wherein two of said dielectric plates which are located inside thereof are convex-shaped.

2. A fan-beam antenna comprising at least:

a flare which is long in a horizontal direction thereof and whose cross section is horn-shaped;

a water-proof box housing components of said antenna; and a radome radiation surface which is located in front of said flare and constituted of a part of said water-proof box;

wherein said radome radiation surface is constituted of a plurality of dielectric plates equivalently;

wherein at least one of said dielectric plates is a dielectric lens having a characteristic similar to a convex lens; and wherein said convex-shaped dielectric plate has a comb-shaped cross section so that comb-tooth portions thereof are longer at a center portion in a vertical surface thereof and shorter at both end portions thereof.

3. A fan-beam antenna according to claim 1, wherein:

said convex-shaped dielectric plates have comb-shaped cross sections so that comb-tooth portions thereof are longer at a center portion in a vertical surface thereof and shorter at both end portions thereof.

* * * * *